US010739730B2

(12) United States Patent
Smith

(10) Patent No.: US 10,739,730 B2
(45) Date of Patent: Aug. 11, 2020

(54) METHODS AND SYSTEMS FOR CONTENT NOTIFICATIONS

(71) Applicant: University of Alaska Anchorage, Anchorage, AK (US)

(72) Inventor: Kristian Smith, Anchorage, AK (US)

(73) Assignee: University of Alaska Anchorage, Anchorage, AK (US)

( * ) Notice: Subject to any disclaimer, the term of this patent is extended or adjusted under 35 U.S.C. 154(b) by 0 days.

(21) Appl. No.: 16/183,451

(22) Filed: Nov. 7, 2018

(65) Prior Publication Data

US 2019/0137942 A1 May 9, 2019

Related U.S. Application Data

(60) Provisional application No. 62/582,738, filed on Nov. 7, 2017.

(51) Int. Cl.

| | |
|---|---|
| ***G04G 9/00*** | (2006.01) |
| ***G04G 17/08*** | (2006.01) |
| ***G04G 21/04*** | (2013.01) |
| ***G08B 6/00*** | (2006.01) |

(52) U.S. Cl.

CPC ..... *G04G 9/007* (2013.01); *G04G 17/08* (2013.01); *G04G 21/04* (2013.01); *G08B 6/00* (2013.01)

(58) Field of Classification Search

CPC ..... G04G 9/00; G04G 9/007; G04G 17/08; G04G 17/083; G04G 5/00; G04G 9/0064; G04G 21/04; G08B 5/222; G08B 5/223; G08B 5/228; G08B 6/00; G04C 21/00; G04C 21/26

See application file for complete search history.

(56) References Cited

U.S. PATENT DOCUMENTS

| | | | | |
|---|---|---|---|---|
| 9,491,578 | B1 * | 11/2016 | Saucedo | H04W 4/029 |
| 2012/0108215 | A1 * | 5/2012 | Kameli | H04M 1/0256 455/412.2 |
| 2013/0303087 | A1 * | 11/2013 | Hauser | H04W 4/80 455/41.2 |
| 2015/0186609 | A1 * | 7/2015 | Utter, II | A61B 5/0022 600/301 |
| 2015/0296480 | A1 * | 10/2015 | Kinsey | H04W 4/80 455/41.3 |
| 2015/0362893 | A1 * | 12/2015 | Masserot | G04G 5/00 368/4 |
| 2017/0012463 | A1 * | 1/2017 | Lynch | H02J 7/0047 |

* cited by examiner

*Primary Examiner* — Thai Pham

(74) *Attorney, Agent, or Firm* — Ballard Spahr, LLP

(57) ABSTRACT

Methods and systems for providing a notification are described. An apparatus for providing a notification to a watch or a smart watch can receive a signal that contains an indication of a notification. The apparatus for providing a notification to a watch or a smart watch can provide a signal to a display in order to display the notification.

24 Claims, 5 Drawing Sheets

METHODS AND SYSTEMS FOR CONTENT NOTIFICATIONS

CROSS REFERENCE TO RELATED APPLICATION

This application claims priority to U.S. Provisional Application No. 62/582,738 filed Nov. 7, 2017, herein incorporated by reference in its entirety.

BACKGROUND

A smart watch is a device that provides smartphone-like capabilities in the form factor of a wrist watch. For example, a smart watch can communicate with a smartphone, and receive notifications such as text message and alerts from the smartphone. The smart watch can then display the notification in order for the wearer of the smart watch to read the notification. Typically, a smart watch has a completely digital display in order for the wearer to be able to easily read the notification. However, by using a digital display for the watch face, the smart watch loses the classic styling of a traditional wristwatch. These and other shortcomings are addressed by the methods and systems described herein.

SUMMARY

It is to be understood that both the following general description and the following detailed description are exemplary and explanatory only and are not restrictive. Provided are apparatuses for a watch.

In one example, the apparatus can contain a battery door assembly configured to be removably coupled to a battery compartment of a watch. The battery door assembly can contain a battery. The apparatus can include a low energy wireless communication circuit coupled to the battery and contained within the battery door assembly. The apparatus can also include a Light Emitting Diode (LED) driver circuit coupled to the battery and contained within the battery door assembly. The apparatus can further include an LED coupled to the LED driver circuit and configured to be affixed to a frame of the watch. The low energy wireless communication circuit can be configured to receive data from an electronic device and provide, based on the received data, a signal to the LED driver circuit. The LED driver circuit can be configured to cause the LED to display, based on the signal, one or more lights.

In another example, the apparatus can contain a battery door assembly configured to be removably coupled to a battery compartment of a watch. The battery door assembly can contain a battery. The apparatus can include a low energy wireless communication circuit coupled to the battery and contained within the battery door assembly. The apparatus can also include an Organic Light Emitting Diode (OLED) driver circuit coupled to the battery and contained within the battery door assembly. The apparatus can further include a transparent OLED screen coupled to the OLED driver circuit and configured to be affixed to a face of the watch. The low energy wireless communication circuit can be configured to receive data from an electronic device and provide, based on the received data, a signal to the OLED driver circuit. The OLED driver circuit can be configured to cause the OLED screen to display, based on the signal, a graphical representation of at least a portion of the received data.

In a further example, the apparatus can contain a battery door assembly configured to be removably coupled to a battery compartment of a watch. The battery door assembly can contain a battery. The apparatus can include an electronic device coupled to the battery and contained within the battery door assembly. The apparatus can also include an OLED driver circuit coupled to the battery and contained within the battery door assembly. The apparatus can further include a transparent OLED screen coupled to the OLED driver circuit and configured to be affixed to a face of the watch. The electronic device can be configured to provide a signal to the OLED driver circuit. The OLED driver circuit can be configured to cause the OLED screen to display, based on the signal, a graphical representation of at least a portion of the received data.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, show examples and together with the description, serve to explain the principles of the methods and systems.

DETAILED DESCRIPTION

Figure 1A:
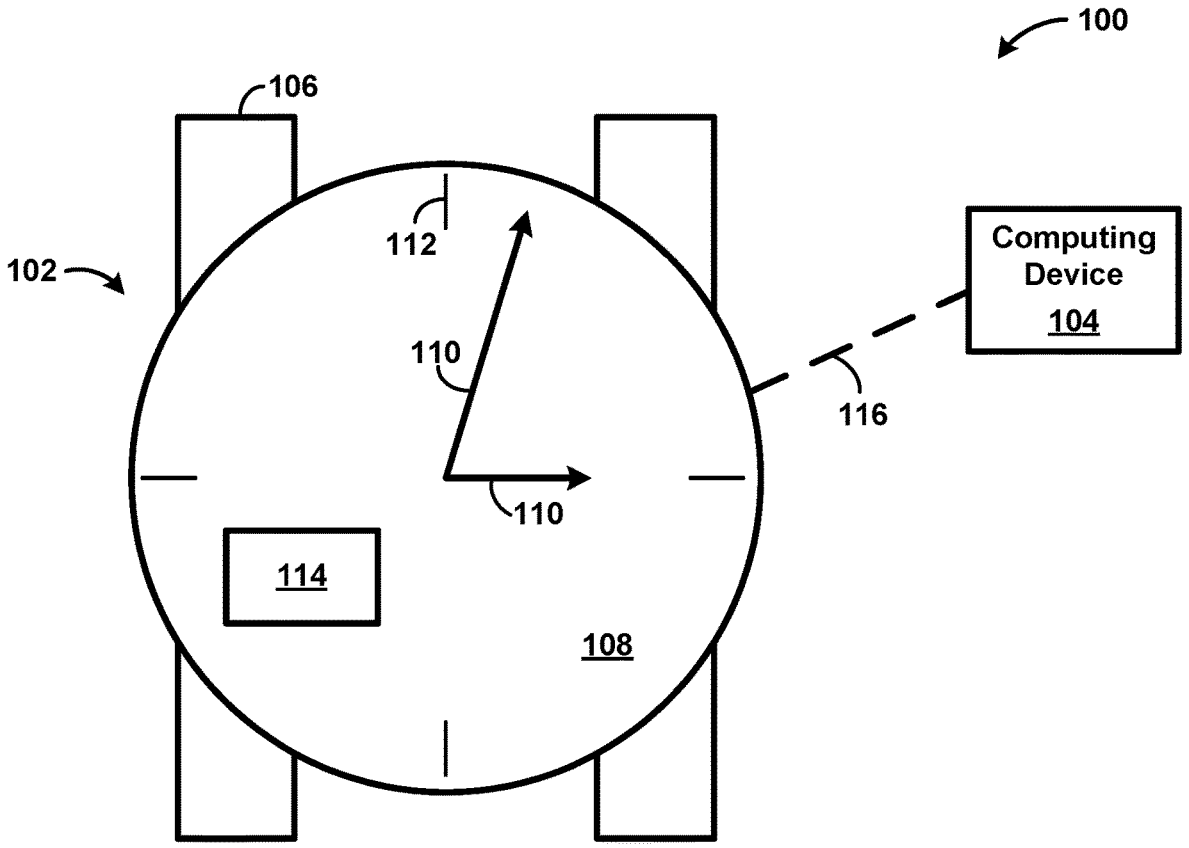
FIGS. 1A and 1B are an example of system.

Before the present methods and systems are disclosed and described, it is to be understood that the methods and systems are not limited to specific methods, specific components, or to particular implementations. It is also to be understood that the terminology used herein is for the purpose of describing particular examples only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another example includes from the one particular value and/or to the other particular value. Similarly, when values are expressed as approximations, by use of the antecedent "about," it will be understood that the particular value forms another example. It will be further understood that the endpoints of each of the ranges are significant both in relation to the other endpoint, and independently of the other endpoint.

"Optional" or "optionally" means that the subsequently described event or circumstance may or may not occur, and that the description includes examples where said event or circumstance occurs and examples where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal example. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all examples of this application including, but not limited to, steps in disclosed methods. Thus, if there are a variety of additional steps that can be performed it is understood that each of these additional steps can be performed with any specific example or combination of examples of the disclosed methods.

The present methods and systems may be understood more readily by reference to the following detailed description of preferred examples and the examples included therein and to the Figures and their previous and following description.

As will be appreciated by one skilled in the art, the methods and systems may take the form of an entirely hardware example, an entirely software example, or an example combining software and hardware example. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Examples of the methods and systems are described below with reference to block diagrams and flowcharts of methods, systems, apparatuses and computer program products. It will be understood that each block of the block diagrams and flowcharts, and combinations of blocks in the block diagrams and flowcharts, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowcharts support combinations of means for performing the specified functions, combinations of steps for performing the specified functions and program instruction means for performing the specified functions. It will also be understood that each block of the block diagrams and flowcharts, and combinations of blocks in the block diagrams and flowcharts, can be implemented by special purpose hardware-based computer systems that perform the specified functions or steps, or combinations of special purpose hardware and computer instructions.

Note that in various examples this detailed disclosure may refer to a given entity performing some action. It should be understood that this language may in some cases mean that a system (e.g., a computer) owned and/or controlled by the given entity is actually performing the action.

FIG. 1A illustrates a system 100 for providing a notification to a watch. The system 100 can comprise one or more of a watch 102 and a computing device 104. The computing device 104 can be any type of electronic device. For example, the computing device 104 can be a computer, a smartphone, a laptop, a tablet, a wireless access point, a server, or any other electronic device. The computing device 104 can include an interface for communicating wirelessly using, for example, Wi-Fi, Bluetooth™, cellular service, etc. As shown, the watch 102 and the computing device 104 can be communicatively coupled via a communications connection 116 as will be described in more detail with regards to FIG. 2.

In an example, the watch 102 is an analog watch. The watch 102 can comprise a frame 106 and a face 108 coupled with the frame 106. The frame 106 can be any suitable material for the frame of a watch (e.g., plastic, stainless steel, aluminum, gold, silver). The face 108 can be any suitable material for a watch face (e.g., plastic, stainless steel, aluminum, precious metals, pearl). The watch 102 can also have hands 110 that indicate the time based on markings 112. The watch 102 can include a cover (not shown), such as crystal or plastic, that protects the watch face 108, the hands 110, and the markings 112. As will be appreciated by one skilled in the art, the watch 102 includes additional mechanical and/or electrical parts for moving the hands 110 that are not shown for ease of explanation.

The watch 102 can comprise one or more displays 114. The display 114 can be located anywhere on the watch 102 such as on the face 108, on outside of the frame 106, and the like. The display 114 can be any device capable of producing light (e.g., a display, a diode, a laser). For example, the display 114 can include one or more Light Emitting Diodes (LED). In one example, the display 114 can be a single LED. For example, the LED is a multi-color LED that is capable of producing a variety of wavelengths of light based on a signal provided to the LED. For example, a driver circuit and/or controller can provide a signal to the LED indicating the wavelength of light desired by the driver circuit and/or controller. As another example, the display 114 can be an electronic display. For example, the display 114 can be an Organic Light Emitting Diode (OLED) display. The display 114 can be coupled with a controller (not shown) that controls operation of the display 114, which will be described in more detail with regards to FIG. 2. While a single display 114 is shown for ease of explanation, a person skilled in the art would appreciate that the display 114 can comprise any number of lights and/or displays that are capable of producing light. Further, while the display 114 is shown as being within the watch frame 106, the display can be located at any place on the watch such as outside the watch face 108, outside the watch frame 106, and so forth.

Figure 1B:
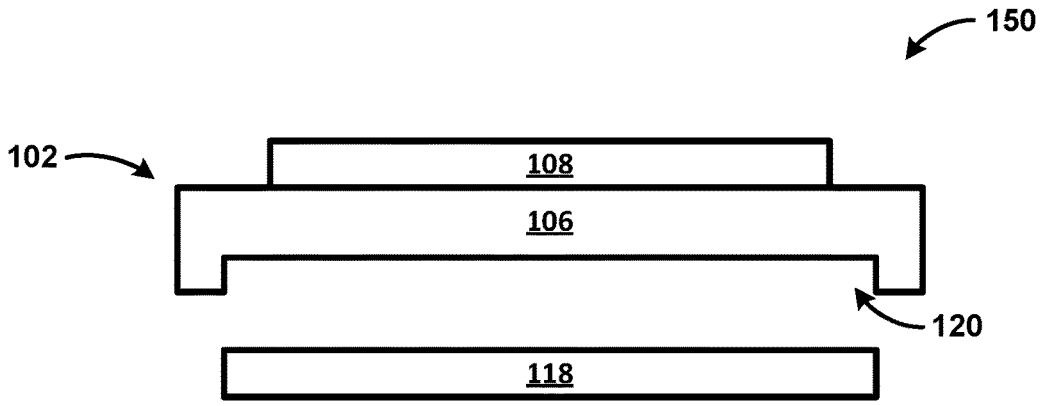

FIG. 1B illustrates a view 150 of the watch 102. Specifically, the view 150 is a side profile view of the watch 102. As shown, the watch face 108 is coupled to the frame 106. The frame 106 includes a recess 120. Below the frame 106 and the recess 120, is a door assembly 118. The door assembly 118 can be securely coupled with the frame 106 by being placed within the recess 120. In one example, the door assembly 118 is a battery door assembly that couples a battery to the mechanical and/or electrical components of the watch 102. The door assembly 118 can include a battery, a controller, a vibration module, and/or a sensor as will be described in more detail with regards to FIG. 2. As will be appreciated by one skilled in the art, view 150 is not drawn to scale.

Figure 2:
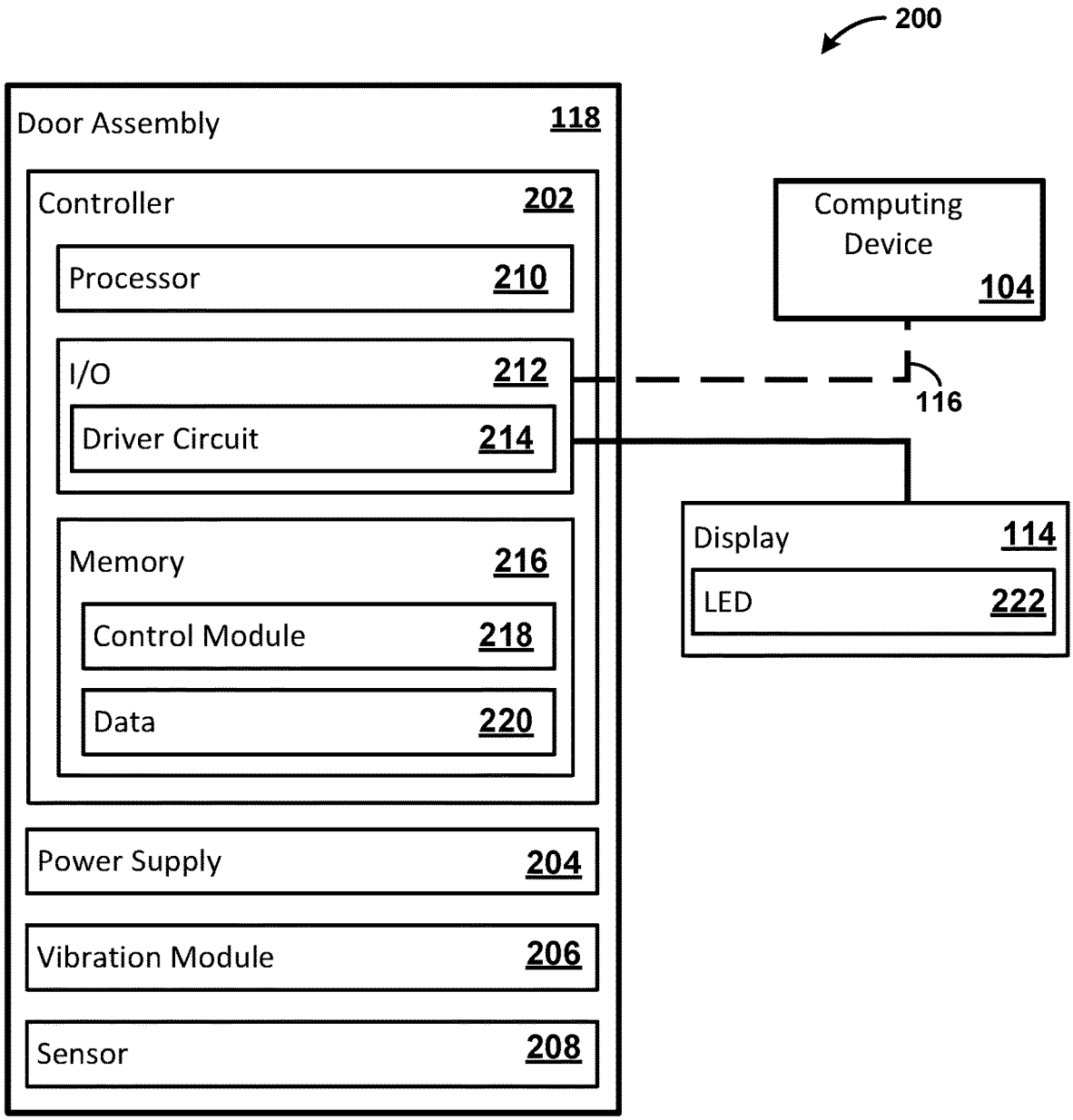
FIG. 2 is an example of a system.

FIG. 2 illustrates an exemplary system 200. As shown, the system 200 includes a door assembly 118, a computing device 104, and a display 114. The door assembly 118 can include a controller 202, a battery 204, a vibration module 206, and/or a sensor 208. The vibration module 206 can provide tactile feedback to a wearer of the watch 102. For example, the vibration module 206 can vibrate to indicate a notification in concert with output on the display 114. The sensor 208 can be any suitable sensor for measuring data. In one example, the sensor 208 is a heart rate sensor which determines the heart rate of a person wearing the watch 1012. As will be appreciated by one skilled in the art, the door assembly 118 can include any number of components and should not be limited to the embodiment shown.

As shown, the controller 202 comprises a processor 210, an input output interface (I/O) 212, and a memory 216. In some examples, the controller 202 can include additional parts such as global positioning system (GPS), motion detectors, and so forth. While a single processor 210 is shown for ease of explanation, a person skilled in the art would appreciate that the controller 202 can include any number of processors 210.

The processor 210 can perform various tasks, such as retrieving information stored in the memory 216, and executing various software modules. For example, the processor 210 can execute the control module 218 that provides instructions, settings, and/or signals to the display 114. As an example, the control module 218 can provide instructions, settings, and/or settings for what should be displayed on display 114. As another example, the control module 218 can provide a control and/or power signal to the display 114 that drives the LED 222.

As shown, the controller 202 is communicatively coupled via the I/O 212 with the computing device 104 and the display 114. As shown, the I/O 212 includes a driver circuit 214. The driver circuit 214 can provide signals, including power, to the display 114. For example, the driver circuit 214 can provide signals to the LED 222 that powers the LED 222, and controls the wavelength of light that the LED 222 produces. For example, the driver circuit 214 can provide Pulse Width Modulation (PWM) signals to the LED to power the LED. The I/O 212 can include any type of suitable hardware for communication with devices. For example, the I/O 212 can include direct connection interfaces such as cables, Ethernet, and Universal Serial Bus (USB), as well as wireless communications, including but not limited to, Wi-Fi, Bluetooth™, cellular, Radio Frequency (RF), and so forth. While not shown, a person skilled in the art would appreciate the controller 202 can be communicatively coupled to the components of the door assembly 118 (e.g., the battery 204, the vibration module 206, and the sensor 208). Further, a person skilled in the art would appreciate that the computing device 104 can be communicatively coupled to the components of the door assembly 118 (e.g., the battery 204, the vibration module 206, and the sensor 208) as well.

The memory 216 includes a control module 218 and data 220. The memory 216 typically comprises a variety of computer readable media. As an example, readable media can be any available media and comprises, for example and not meant to be limiting, both volatile and non-volatile media, removable and non-removable media. The memory 216 can comprise computer readable media in the form of volatile memory, such as random access memory (RAM), and/or non-volatile memory, such as read only memory (ROM).

In another example, the memory 216 can also comprise other removable/non-removable, volatile/non-volatile computer storage media. The memory 216 can provide non-volatile storage of computer code, computer readable instructions, data structures, program modules, and other data for the controller 202. For example, a mass storage device can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

The memory 216 can store software that is executable by the processor 210, including operating systems, applications, and related software. The memory 216 also includes data 220. The data 220 can include data received from the computing device 104, settings or preferences for the display 114, data from other components of the door assembly 118, settings or preferences for operating the controller 202, or any suitable type of data. As an example, the data 220 can include settings that indicate the signals that should be sent to the display 114. As another example, the data 220 can include data that indicates how the controller 202 should communicate with the computing device 104. While not shown, a person skilled in the art would appreciate that the memory 216 can also include additional software and/or firmware for operating the controller 202.

In one example, the control module 218 includes the functionality to operate the display 114. For example, the control module 218 includes the functionality to communicate with the display 114 and provide operational instructions and/or signals to the display 114. As an example, the control module 218 can provide control signals to the display 114. For example, the control signals can dictate that the display 114 produces an output, the intensity of the output, how long the display 114 should be activated, the wavelength of light produced by the display 114, the brightness of light produced by the display 114, and so forth. As another example, the control module 218 can receive input from a user that instructs the control module 218 to have the controller 202 activate the display 114. The control module 218 can receive output signals and/or data from the display 114, and the control module 218 can use the data to determine how the display 114 should be controlled. For example, the display 114 can be a touch sensitive display that receives touch input from a user. The control module 218 can receive the touch input from the display 114, and adjust the operation of the display 114 as necessary.

As another example, the control module 218 can determine that the display 114 needs to increase the brightness of the output in order to be more visible due to lighting conditions. For example, the control module 218 can use a sensor (e.g., a light sensor, photodetector) to determine the ambient light. Based on the ambient light, the control module 218 can instruct display 114 to increase the brightness or decrease the brightness of the output of the display 114. As an example, the display 114 can produce an output a lower brightness when the ambient light is dark as a bright light could be uncomfortable to a user.

The controller 202 and the computing device 104 can communicate via a communications connection 116. As an example, the communications connection 116 can be a wireless network (e.g., Wi-Fi, Bluetooth™). The computing device 104 and the controller 202 can exchange data using the communications connection 116. For example, the computing device 104 can send data (e.g., notifications, instructions, settings, signals) to the controller 202. As an example, the computing device 104 can send data indicating a notification. The controller 202 can receive the data, and in turn, communicate with the display 114 to have the display 114 display an output related to the notification. As an example, the computing device 104 can receive an email, and the computing device 104 transmits to the controller 202 data indicating receipt of the email. The controller 202 in turn transmits signals and/or settings to the display 114 for output to indicate a notification related to the receipt of the email. While the computing device 104 and the controller 202 are illustrated as directly communicating via the communications connection 116, a person skilled in the art would appreciate that the computing device 104 and the controller 202 can communicate via additional devices. For example, the computing device 104 can communicate with a device such as a server or wireless router, which in turn communicates with the controller 202.

As another example, the controller 202 can provide data related to the display 114 to the computing device 104. The controller 202 can also provide the current operational status of the display 114. For example, the controller 202 can provide data to the computing device 104 indicating that the display 114 is displaying an output, as well as what the output is. As another example, the controller 202 can provide data indicating that the display 114 is not currently displaying any output.

In one exemplary embodiment, the computing device 104 transmits data to the controller 202 via Bluetooth™. For example, the computing device 104 transmits data indicating a Red Green Blue (RGB) value that the display 114 should output. As an example, the computing device 104 transmits 8 bits of data representing red, 8 bits of data representing green, and 8 bits of data representing green to the controller 202. For example, the computing device 104 transmits 24 bits of data containing the RGB value to the controller 202. As another example, the computing device 104 transmits data indicating whether the display 114 should be a constant display, pulse and/or flash, and so forth. For example, the computing device 104 transmits one bit of data to the controller 202 that indicates the display 114 should be flashing. The controller 202 in turn provides settings and/or signals to the display 114 to cause the display 114 to output a flash.

In one example, the communication between the controller 202 and the computing device 104 is not constant. Rather, the communication between the controller 202 and the computing device 104 is a two-way interrupt communication. For example, the computing device 104 transmits instructions/data to the controller 202 that indicates the desired operation of the controller 202 and/or the display 114. The controller 202 and/or the display 114 will continue to operate under the instructions/data sent from the computing device 104 until the computing device 104 transmits a new set of instructions/data. This can allow the controller 202 to reduce battery consumption by only receiving data when the computing device 104 desires to display a notification, or deactivate display of a notification.

In one example, the communication between the controller 202 and the computing device 104 is verified. For example, after the controller 202 receives data from the computing device 104, the controller transmits the data back to the computing device 104 to confirm receipt of the data. The computing device 104 receives the data and confirms that the data sent by the controller 202 matches what the computing device 104 sent to the controller 202. If the received data does not match the sent data, the computing device 104 transmits the data again.

The computing device 104 can also transmit settings or instructions to the controller 202 to manage operation of the controller 202. For example, the computing device 104 can transmit settings to the controller 202 that indicate power management settings for the controller 202. As another example, the computing device 104 can transmit settings to the controller 202 that indicate when the controller 202 should provide data to the computing device 104. As further example, the computing device 104 can provide software to the controller 202 that provides instruction for data collection from the display 114. For example, if the display 114 is a touch sensitive display, the controller 202 can receive instructions on how to handle any input provided to the controller 202 by the display 114. As one example, the computing device 104 can indicate start and stop times that the controller 202 should produce an output using the display 114. As another example, the computing device 104 can indicate times that the controller 202 should start dynamically controlling the display 114. In one example, a user of the computing device 104 actively selects the instructions or settings that are transmitted to the controller 202. In another example, the computing device 104 dynamically decides the instructions or settings that are transmitted to the controller 202 without input from a user. In another example, the computing device 104 receives input from a user indicating the preferences and/or settings the user would like the computing device 104 to implement. The computing device 104 can then automatically transmit instructions to the controller 202 based on the user indicated preferences and/or settings.

The computing device 104 can also transmit settings or instructions to the controller 202 to manage how the controller 202 controls the display 114. For example, the computing device 104 can transmit settings to the controller 202 that indicate the timing of how the controller 202 should activate the display 114. As one example, the computing device 104 can indicate start and stop times that the controller 202 should activate the display 114.

As another example, the computing device 104 can transmit settings to the controller 202 that indicate what the display 114 should output in response to data from the computing device 104. For example, the computing device 104 can transmit settings to the controller 202 that indicate how the controller 202 should operate upon receiving data from the computing device 104. As an example, the computing device 104 can transmit an indication of a notification to the controller 202. The controller 202 can receive the notification, determine output settings and/or signals for the display 114 based on the settings previously provided by the computing device 104, and then the controller 202 can provide settings and/or signals to the display 114 to display the proper output based on the notification provided by the computing device 104.

As another example, the computing device 104 can indicate times that the controller 202 should start dynamically controlling the display 114. For example, the computing device 104 can instruct the controller 202 to dynamically control the display 114 after the controller 202 receives data indicative of a notification. As a further example, the computing device 104 can indicate how the controller 202 should provide data to the computing device 104 from the display 114. For example, the display 114 can be a touch sensitive display, and the computing device 104 provides settings and/or instructions to the controller 202 for how the controller 202 should operate when the display 114 provides data representative of an input to the controller 202.

In one example, a user of the computing device 104 actively selects the instructions or settings that are transmitted to the controller 202. In another example, the computing device 104 dynamically decides the instructions or settings that are transmitted to the controller 202 without input from a user. In another example, the computing device 104 receives input from a user indicating the preferences and/or settings the user would like the computing device 104 to implement. The computing device 104 can then automatically transmit instructions to the controller 202 based on the user indicated preferences and/or settings. In one example, the user of the computing device 104 selects specific settings for the display 114.

As a further example, the computing device 104 can provide a control signal to the controller 202 in order to control operation of the display 114. The control signal can include settings for the display 114, data related to settings of the display 114, instructions for the display 114, and any information related to the control of the display 114. As an example, the computing device 104 can transmit a control signal to the controller 202, and the controller 202 transmits the control signal to the display 114.

In one example, the computing device 104 is a smartphone that has an application that controls operation of the controller 202 and the display 114. For example, the application includes settings for different colors the display 114 can output based on what the smartphone receives (e.g., text message, phone call, email). As another example, the application includes settings that control whether the display 114 pulses or is constant. As a further example, the application includes a priority for notifications based on what is received. For example, if two notifications, such as an email message and a social media message, are received by the smartphone at the same time, the application can indicate that a notification for the email should be output over the notification for the social media message.

As shown in FIG. 2, the door assembly 118 also includes a power supply 204. The power supply 204 can be any suitable method of providing power to the controller 202 and the display 114. In one example, the power supply 204 is a battery (e.g., Lithium-Ion, alkaline). For example, the battery can be a watch battery that provides power to the watch 102. As another example the power supply 204 can be a direct power connection (e.g., wired) to an external source (e.g., 120 V, 240 V), and/or a wireless power connection (e.g., induction) to an external source. In one example, the power supply 204 is a battery providing sufficient power for the controller 202 to operate, as well as sufficient power to operate the display 114. Further, as will be appreciated by one skilled in the art, the power supply 204 can include additional elements such as a voltage regulator, amplifiers, filters, and so forth. While a single power supply 204 is illustrated for ease of explanation, a person skilled in the art would appreciate additional power supplies 204 can be present that can include similar or different power sources.

Figure 3:
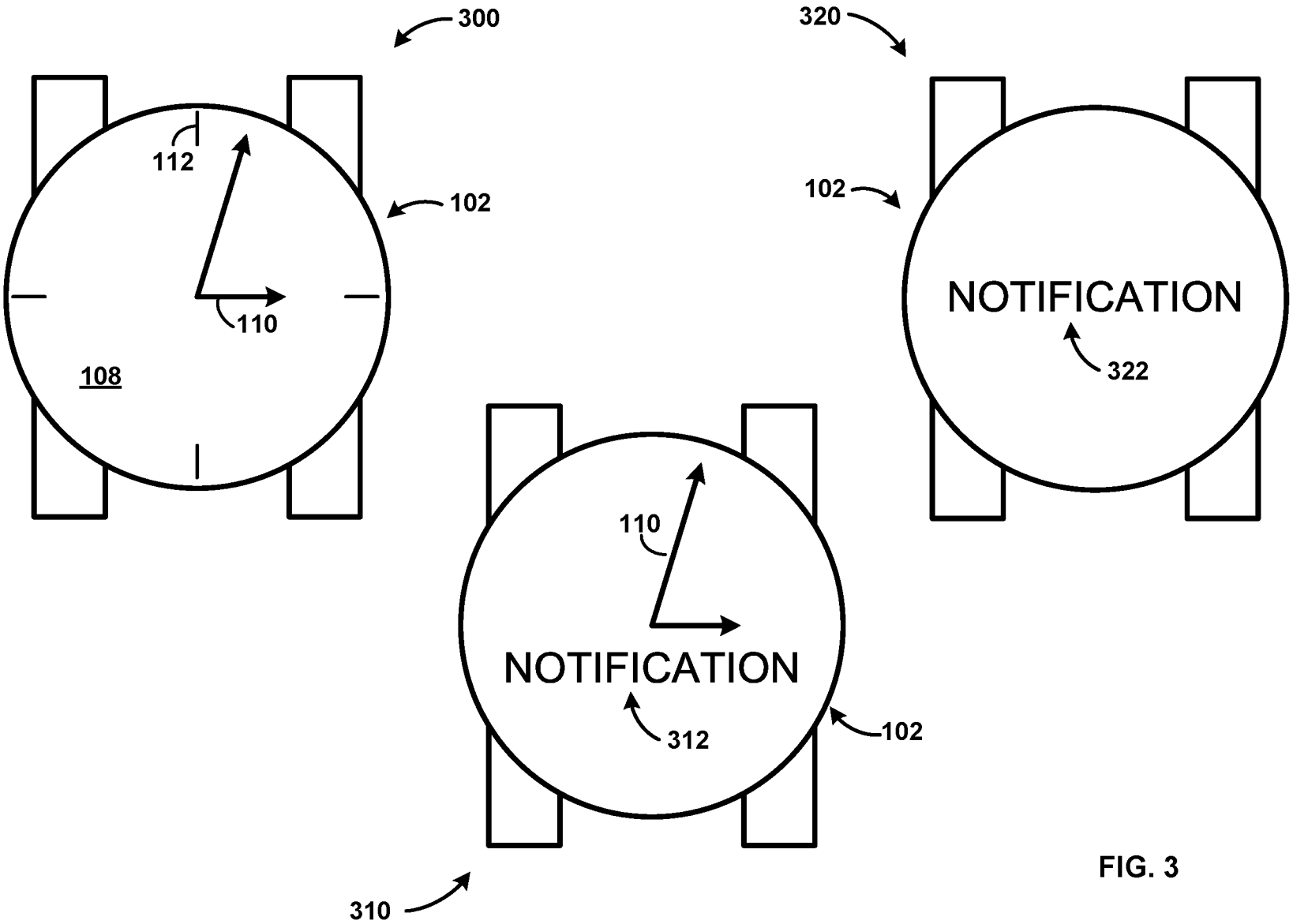
FIG. 3 is an example of a system.

FIG. 3 illustrates an example apparatus. In example, the display 114 (not shown) can be a display that covers the watch face 108 and markings 112. For example, the display 114 can be a transparent OLED display that is no longer transparent when activated. In one example, the display 114 is transparent even after activation. As shown, view 300 illustrates watch 102 before a notification is received with the watch face 108, the hands 110, and the markings 112 visible. View 310 illustrates the watch 102 after receiving a notification 312. As shown, the notification 312 covers the watch face 108 and the markings 112. However, the hands 110 are still visible to the wearer of the watch 102. View 320 illustrates another example of the watch 102 after receiving a notification 322. In this example, the notification 322 covers the watch face 108, the hands 110, and the markings 112 of the watch 102.

Figure 4:
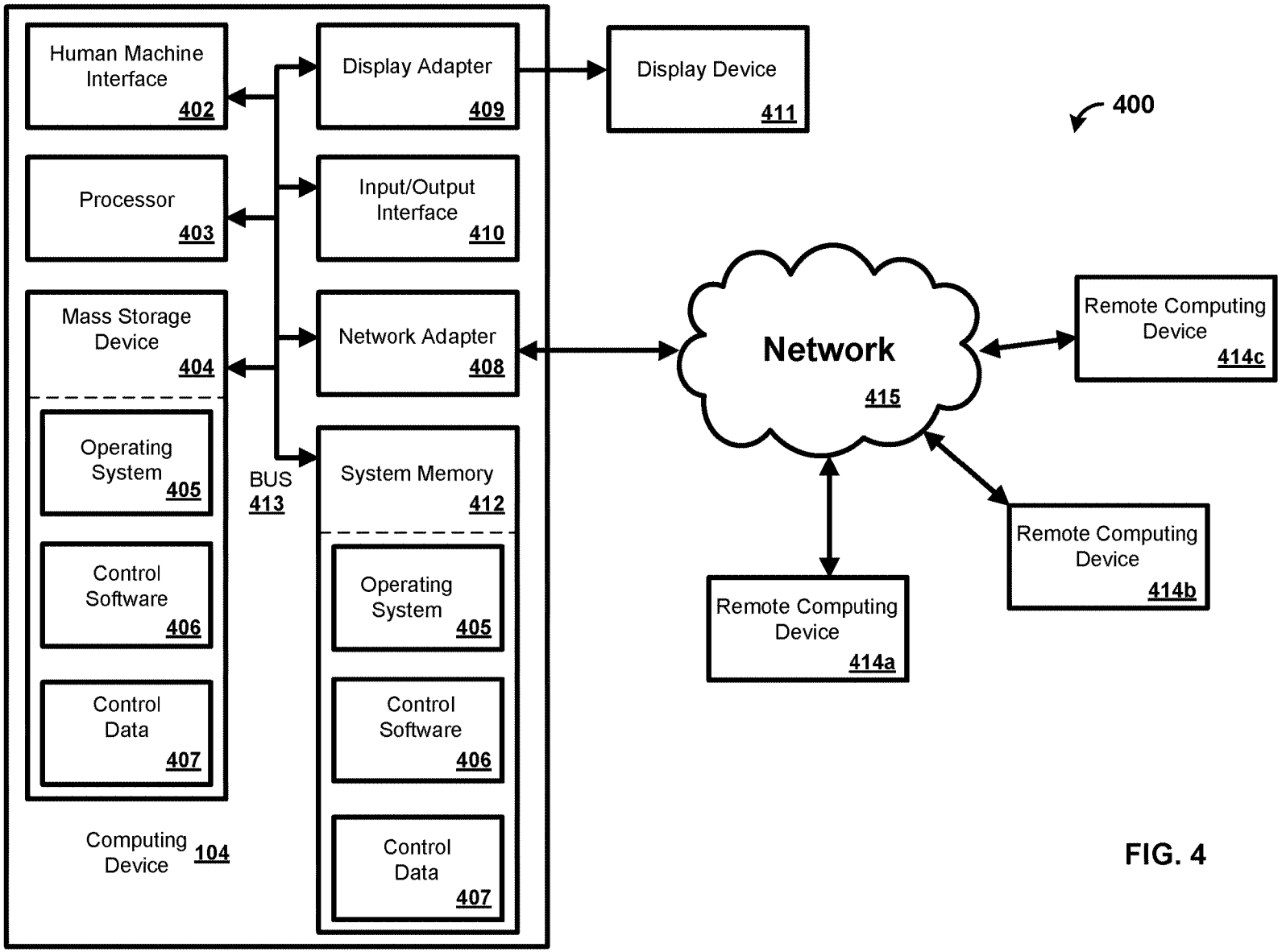
FIG. 4 is a block diagram of an example computing device.

FIG. 4 shows an example of an operating environment 400 including the computing device 104. While the computing device 104 shown for ease of explanation, it is to be understood that the controller 202 and the display 114 can include any and all of the functionality described below. The operating environment 400 is only an example of an operating environment and is not intended to suggest any limitation as to the scope of use or functionality of operating environment architecture. Neither should the operating environment 400 be interpreted as having any dependency or requirement relating to any one or combination of components illustrated in the operating environment 400.

The present methods and systems can be operational with numerous other general purpose or special purpose computing system environments or configurations. Examples of well-known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, and/or the like that perform particular tasks or implement particular abstract data types. The disclosed methods can also be practiced in grid-based and distributed computing environments where tasks are performed by remote processing devices that are linked through a communications network. In a distributed computing environment, program modules can be located in local and/or remote computer storage media including memory storage devices.

Further, one skilled in the art will appreciate that the systems and methods disclosed herein can be implemented via a general-purpose computing device in the form of a computing device 104. The computing device 104 can comprise one or more components, such as one or more processors 403, a system memory 412, and a bus 413 that couples various components of the computing device 104 including the one or more processors 403 to the system memory 412. In the case of multiple processors 403, the system can utilize parallel computing.

The bus 413 can comprise one or more of several possible types of bus structures, such as a memory bus, memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 413, and all buses specified in this description can also be implemented over a wired or wireless network connection and one or more of the components of the computing device 104, such as the one or more processors 403, a mass storage device 404, an operating system 405, control software 406, control data 407, a network adapter 408, a system memory 412, an Input/Output Interface 410, a display adapter 409, a display device 411, and a human machine interface 402, can be contained within one or more remote computing devices 414*a,b,c* at physically separate locations, connected through buses of this form, in effect implementing a fully distributed system.

The computing device 104 typically comprises a variety of computer readable media. As an example, readable media can be any available media that is accessible by the computing device 104 and comprises, for example and not meant to be limiting, both volatile and non-volatile media, removable and non-removable media. The system memory 412 can comprise computer readable media in the form of volatile memory, such as random access memory (RAM), and/or non-volatile memory, such as read only memory (ROM). The system memory 412 typically can comprise data such as control data 407 and/or program modules such as operating system 405 and control software 406 that are accessible to and/or are operated on by the one or more processors 403.

In another example, the computing device 104 can also comprise other removable/non-removable, volatile/non-volatile computer storage media. The mass storage device 404 can provide non-volatile storage of computer code, computer readable instructions, data structures, program modules, and other data for the computing device 104. For example, a mass storage device 404 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 404, including by way of example, an operating system 405 and control software 406. One or more of the operating system 405 and control software 406 (or some combination thereof) can comprise program modules and the control software 406. The control data 407 can also be stored on the mass storage device 404. The control data 407 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple locations within the network 415.

In one example, the control software 406 includes the functionality to operate the controller 202. For example, the control software 406 includes the functionality to communicate with the display 114 and provide operational instructions and/or signals to the display 114. As an example, the control software 406 can provide control signals to the display 114. For example, the control signals can dictate that the display 114 produces an output, the intensity of the output, how long the display 114 should be activated, the wavelength of light produced by the display 114, the brightness of light produced by the display 114, and so forth. As another example, the control software 406 8 can receive input from a user that instructs the control software 406 to have the controller 202 activate the display 114. The control software 406 can receive output signals and/or data from the display 114, and the control software 406 can use the data to determine how the display 114 should be controlled. For example, the display 114 can be a touch sensitive display that receives touch input from a user. The control software 406 can receive the touch input from the display 114, and adjust the operation of the display 114 as necessary.

As another example, the control software 406 can also transmit settings or instructions to the controller 202 to manage operation of the controller 202. For example, the control software 406 can transmit settings to the controller 202 that indicate power management settings for the controller 202. As another example, the control software 406 can transmit settings to the controller 202 that indicate when the controller 202 should provide data to the control software 406. As further example, the control software 406 can provide software to the controller 202 that provides instruction for data collection from the display 114. As one example, the control software 406 can indicate start and stop times that the controller 202 should produce an output using the display 114. As another example, the control software 406 can indicate times that the controller 202 should start dynamically controlling the display 114. In one example, a user of the control software 406 actively selects the instructions or settings that are transmitted to the controller 202. In another example, the control software 406 dynamically decides the instructions or settings that are transmitted to the controller 202 without input from a user. In another example, the control software 406 receives input from a user indicating the preferences and/or settings the user would like the control software 406 to implement. The control software 406 can then automatically transmit instructions to the controller 202 based on the user indicated preferences and/or settings.

In one example, the control software 406 is a web based or telecommunications based server that has an associated interface that a user can access which controls the functionality of the controller 202 and the display 114.

In another example, the user can enter commands and information into the computing device 104 via an input device (not shown). Examples of such input devices comprise, but are not limited to, a keyboard, pointing device (e.g., a computer mouse, remote control), a microphone, a joystick, a scanner, tactile input devices such as gloves, and other body coverings, motion sensor, and the like. These and other input devices can be connected to the one or more processors 403 via a human machine interface 402 that is coupled to the bus 413, but can be connected by other interface and bus structures, such as a parallel port, game port, an IEEE 1394 Port (also known as a Firewire port), a serial port, network adapter 408, and/or a universal serial bus (USB).

In yet another example, a display device 411 can also be connected to the bus 413 via an interface, such as a display adapter 409. It is contemplated that the computing device 104 can have more than one display adapter 409 and the computing device 104 can have more than one display device 411. For example, a display device 411 can be a monitor, an LCD (Liquid Crystal Display), light emitting diode (LED) display, television, smart lens, smart glass, and/or a projector. In addition to the display device 411, other output peripheral devices can comprise components such as speakers (not shown) and a printer (not shown) which can be connected to the computing device 104 via Input/Output Interface 410. Any step and/or result of the methods can be output in any form to an output device. Such output can be any form of visual representation, including, but not limited to, textual, graphical, animation, audio, tactile, and the like. The display 411 and the computing device 104 can be part of one device, or separate devices.

The computing device 104 can operate in a networked environment using logical connections to one or more remote computing devices 414*a,b,c*. By way of example, a remote computing device 414*a,b,c* can be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. As an example, remote computing devices 414*a,b,c* can be the computing device 104, the controller 202, and the display 114. Logical connections between the computing device 104 and a remote computing device 414*a,b,c* can be made via a network 415, such as a local area network (LAN) and/or a general wide area network (WAN). Such network connections can be through a network adapter 408. A network adapter 408 can be implemented in both wired and wireless environments. Such networking environments are conventional and commonplace in dwellings, offices, enterprise-wide computer networks, intranets, and the Internet.

For purposes of illustration, application programs and other executable program components such as the operating system 405 are shown herein as discrete blocks, although it is recognized that such programs and components can reside at various times in different storage components of the computing device 104, and are executed by the one or more processors 403 of the computing device 104. An implementation of control software 406 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" can comprise volatile and non-volatile, removable and non-removable media implemented in any methods or technology for storage of information such as computer readable instructions, data structures, program modules, or other data. Exemplary computer storage media can comprise RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The methods and systems can employ artificial intelligence (AI) techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

Figure 5:
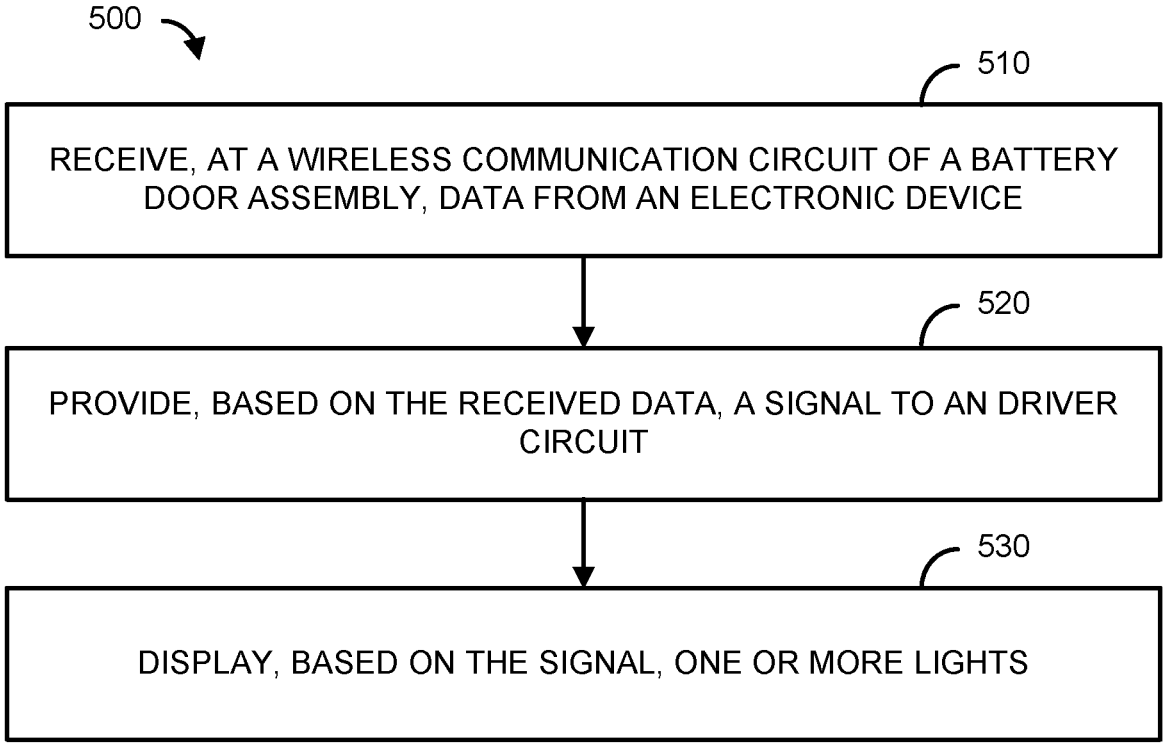
FIG. 5 is a flowchart of an example method.

FIG. 5 is a flowchart of an example method 500. At step 510, a wireless communication circuit (e.g., the controller 202) receives data from an electronic device (e.g., the computing device 104). For example, the controller 202 can receive data related to a notification from the computing device 104. In one example, the data can be received via a Bluetooth™ network.

At step 520, a signal is provided to a driver circuit (e.g., the controller 202) based on the received data. For example, the controller 202 can provide a signal to the display 114 to produce an output based on the received signal.

At step 530, one or more lights are displayed based on the signal. For example, the display 114 can output a display based on the signal provided by the controller 202. As an example, the display 114 can be an LED that produces light based on the signal provided by the driver circuit.

While the methods and systems have been described in connection with specific examples, it is not intended that the scope be limited to the particular examples set forth, as the examples herein are intended in all respects to be possible examples rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of examples described in the specification.

It will be apparent to those skilled in the art that various modifications and variations can be made without departing from the scope or spirit. Other examples will be apparent to those skilled in the art from consideration of the specification and practice disclosed herein. It is intended that the specification and examples be considered as exemplary only, with a true scope and spirit being indicated by the following claims.

What is claimed is:

1. An apparatus for providing a notification to a watch or a smart watch by an electronic device comprising:

a battery door assembly for a watch, configured to be removably coupled to a battery compartment of the watch;

a battery contained within the battery door assembly;

a low energy wireless communication circuit, coupled to the battery, contained within the battery door assembly;

a Light Emitting Diode (LED) driver circuit, coupled to the battery, contained within the battery door assembly;

an LED, coupled to the LED driver circuit, configured to be affixed to a frame of the watch;

wherein the low energy wireless communication circuit is configured to, receive data from an electronic device, and provide, based on the received data, a signal to the LED driver circuit; and wherein the LED driver circuit is configured to cause the LED to display, based on the signal, one or more lights.

2. The apparatus of claim 1, wherein the electronic device is a mobile telephone.

3. The apparatus of claim 1, further comprising a vibration module configured to vibrate the apparatus when the LED displays one or more lights.

4. The apparatus of claim 1, wherein the battery is at least one of a lithium ion battery or an alkaline battery.

5. An apparatus for providing a notification to a watch or a smart watch by an electronic device comprising:

a battery door assembly for a watch, configured to be removably coupled to a battery compartment of the watch;

a battery contained within the battery door assembly;

a low energy wireless communication circuit, coupled to the battery, contained within the battery door assembly;

an Organic Light Emitting Diode (OLED) driver circuit, coupled to the battery, contained within the battery door assembly;

a transparent OLED screen, coupled to the OLED driver circuit, configured to be affixed to a face of the watch;

wherein the low energy wireless communication circuit is configured to, receive data from an electronic device, and provide, based on the received data, a signal to the OLED driver circuit; and wherein the OLED driver circuit is configured to cause the OLED screen to display, based on the signal, a graphical representation of at least a portion of the received data.

6. The apparatus of claim 5, wherein the electronic device is a mobile telephone.

7. The apparatus of claim 6, wherein at least a portion of the data received from the electronic device includes information relating to telephone calls.

8. The apparatus of claim 5, further comprising a vibration module configured to vibrate the apparatus when the OLED screen displays selected information.

9. The apparatus of claim 5, wherein at least a portion of the data received from the electronic device includes information relating to the weather.

10. The apparatus of claim 5, wherein at least a portion of the data received from the electronic device includes information relating to sporting events.

11. The apparatus of claim 5, wherein at least a portion of the data received from the electronic device includes information relating to news.

12. The apparatus of claim 5, wherein at least a portion of the data received from the electronic device includes information relating to at least one of electronic mail, messaging applications, or social media applications.

13. The apparatus of claim 5, wherein the face of the watch displays data independently of the OLED screen, wherein such data is visible through the OLED screen.

14. The apparatus of claim 5, wherein the battery is at least one of a lithium ion battery or an alkaline battery.

15. The apparatus of claim 5, further comprising a sensor configured to collect information relating to a heart rate of an individual wearing the watch.

16. An apparatus for providing a notification to a watch or a smart watch by an electronic device comprising:

a battery door assembly for a watch, configured to be removably coupled to a battery compartment of the watch;

a battery contained within the battery door assembly;

an electronic device, coupled to the battery, contained within the battery door assembly;

an Organic Light Emitting Diode (OLED) driver circuit, coupled to the battery, contained within the battery door assembly;

a transparent OLED screen, coupled to the OLED driver circuit, configured to be affixed to a face of the watch;

wherein the electronic device is configured to provide a signal to the OLED driver circuit; and wherein the OLED driver circuit is configured to cause the OLED screen to display, based on the signal, a graphical representation of at least a portion of the received data.

17. The apparatus of claim 16, further comprising a vibration module configured to vibrate the apparatus when the OLED screen displays selected information.

18. The apparatus of claim 16, wherein at least a portion of the data received from the electronic device includes information relating to the weather.

19. The apparatus of claim 16, wherein at least a portion of the data received from the electronic device includes information relating to sporting events.

20. The apparatus of claim 16, wherein at least a portion of the data received from the electronic device includes information relating to news.

21. The apparatus of claim 16, wherein at least a portion of the data received from the electronic device includes information relating to at least one of electronic mail, messaging applications, or social media applications.

22. The apparatus of claim 16, wherein the face of the watch displays data independently of the OLED screen, wherein such data is visible through the OLED screen.

23. The apparatus of claim 16, wherein the battery is at least one of a lithium ion battery or an alkaline battery.

24. The apparatus of claim 16, further comprising a sensor configured to collect information relating to a heart rate of an individual wearing the watch.

* * * * *